US006209351B1

(12) United States Patent
Zeleny

(10) Patent No.: US 6,209,351 B1
(45) Date of Patent: Apr. 3, 2001

(54) INTERCHANGEABLE JEWELRY ACCESSORY

(76) Inventor: Christine L. Zeleny, 219 Glenmore Dr., Gretna, NE (US) 68028

( * ) Notice: Subject to any disclaimer, the term of this patent is extended or adjusted under 35 U.S.C. 154(b) by 0 days.

(21) Appl. No.: 09/218,440

(22) Filed: Dec. 22, 1998

Related U.S. Application Data

(60) Provisional application No. 60/077,842, filed on Mar. 13, 1998.

(51) Int. Cl.[7] ..... A44C 13/00

(52) U.S. Cl. ..... 63/1.16; 63/20; 63/23; 63/26; 63/28; 63/29.1

(58) Field of Search ..... 63/1.11, 1.16, 63/1.17, 20, 23, 26, 28, 29.1, 43, FOR 1.1; 132/107, 156, 219, 280, 281

(56) References Cited

U.S. PATENT DOCUMENTS

| | | | | |
|---|---|---|---|---|
| 235,571 | * | 12/1880 | Prevear | 132/219 |
| 363,076 | * | 5/1887 | Meerbott, Jr. | 63/29.1 |
| 984,058 | * | 2/1911 | Zimmermann | 63/29.1 |
| 996,678 | * | 7/1911 | Reynolds | 63/29.1 |
| 1,068,244 | * | 7/1913 | Jacobsen | 132/281 |
| 1,469,450 | * | 10/1923 | Stone | 63/28 |
| 1,873,543 | * | 8/1932 | Carlson | 132/275 |
| 2,100,554 | * | 11/1937 | Tavani | 63/1.17 |
| 2,198,558 | * | 4/1940 | Handman | 63/1.17 X |
| 3,014,298 | * | 12/1961 | Kirshner | 63/29.1 X |

FOREIGN PATENT DOCUMENTS

| | | | | |
|---|---|---|---|---|
| 875462 | * | 9/1942 | (FR) | 63/1.1 |
| 1320071 | * | 1/1963 | (FR) | 63/1.1 |
| 1571478 | * | 6/1969 | (FR) | 63/29.1 |

* cited by examiner

*Primary Examiner*—Michael F. Trettel
*Assistant Examiner*—Andrea Chop
(74) *Attorney, Agent, or Firm*—Adam H. Jacobs

(57) ABSTRACT

An interchangeable jewelry accessory for accessorizing a setting-mounted gemstone includes an ornament support base having an ornament support section and a setting-engaging clip section projecting from the ornament support section. The ornament support section includes an ornament mount and at least one ornament mounted on the ornament mount. The setting-engaging clip section includes at least one projecting arm having a releasable securement device thereon, the releasable securement device operative to releasably secure the projecting arm on the gemstone setting such that the ornament support section is supported generally adjacent to the gemstone for accessorizing the gemstone.

5 Claims, 4 Drawing Sheets

INTERCHANGEABLE JEWELRY ACCESSORY

CROSS-REFERENCE TO RELATED PROVISIONAL PATENT

This application claims priority based on a provisional patent, specifically on the Provisional Patent Application Serial No. 60/077,842 filed Mar. 13, 1998.

BACKGROUND OF THE INVENTION

1. Technical Field

The present invention relates to jewelry accessories and, more particularly, to an interchangeable jewelry accessory for accessorizing a setting-mounted gemstone which includes an ornament support base having an ornament support section for supporting a plurality of decorative ornaments adjacent to the setting-mounted gemstone and a setting-engaging clip section projecting from the ornament support section which includes at least one projecting arm having a releasable securement device thereon, the releasable securement device operative to releasably secure the projecting arm on the gemstone setting such that the ornament support section is supported generally adjacent to the gemstone for accessorizing the gemstone.

2. Description of the Prior Art

Many different kinds of jewelry have been produced throughout the long history of jewelry production, but one of the most consistently popular types of jewelry produced is the single gemstone mounted on a setting which in turn is then mounted on a ring, necklace, pendant or the like. Such mounted gemstones include diamonds, rubies, sapphires, etc., and the gemstones are usually mounted on a gold or platinum setting. It is also common to find semi-precious stones such as amethysts, garnet, and other such stones mounted on similar settings to highlight the singular nature of the gemstone. To date, however, a person wearing such a stone does not have the opportunity to "personalize" the gemstone beyond the mere act of choosing the cut, type, and setting for the gemstone.

Various types of jewelry enhancement devices have been proposed in the prior art, including such devices as shown in Monderer, et al., U.S. Pat. No. 5,022,237, Ford, U.S. Pat. No. 4,899,556, and Burrell, U.S. Pat. No. 4,519,220. Each of these prior art devices discloses a variation of the same theme, namely, to provide a way in which the jewelry may be modified or its appearance changed to coordinate with various outfits. However, of the various prior art devices shown, none are designed to enhance the appearance or uniqueness of a solitary mounted gemstone beyond merely exchanging one for another. There is therefore a need for such a device. It is also important that any jewelry enhancement device be unobtrusive and not obstruct any part of the solitary gemstone itself, which should be the focus of the jewelry piece in any event. Clearly, any device which attaches or mounts to the gemstone itself would necessarily obstruct a portion of the gemstone and might actually render it less valuable in the eyes of persons viewing the piece. It is therefore an important object of any such jewelry enhancement device that the solitary gemstone actually be enhanced by the addition of the device and not devalue.

Therefore, an object of the present invention is to provide an improved interchangeable jewelry accessory for accessorizing a setting-mounted gemstone.

Another object of the present invention is to provide an interchangeable jewelry accessory which may be removably mounted to the setting of the gemstone and highlight the gemstone by partially surrounding the gemstone with tasteful ornamentation.

Another object of the present invention is to provide an interchangeable jewelry accessory which includes a setting-engaging clip section for removably and releasably securing the gemstone-enhancing ornaments adjacent the gemstone.

Another object of the present invention is to provide an interchangeable jewelry accessory that can be used on virtually any type of setting, including pyramidal or prong settings used for ring-mounted gemstone settings.

Another object of the present invention is to provide an interchangeable jewelry accessory which contemplates the use of many different kinds of ornaments to be mounted adjacent to the gemstone so that the wearer of the gemstone may accessorize the gemstone according to the whims of the wearer.

Finally, an object of the present invention is to provide an interchangeable jewelry accessory that may be quickly and easily added to a jewelry piece and which is attractive, stylish and non-intrusive.

SUMMARY OF THE INVENTION

The present invention provides an interchangeable jewelry accessory for accessorizing a setting-mounted gemstone which includes an ornament support base having an ornament support section and a setting-engaging clip section projecting from the ornament support section. The ornament support section includes an ornament mount which is an arcuate bar and at least one ornament mounted on the ornament mount for accessorizing and highlighting the adjacent gemstone. The setting-engaging clip section includes at least one projecting arm on which is mounted a releasable securement device such as a clip or protrusion, the releasable securement device operative to releasably secure the projecting arm on a gemstone setting beneath the gemstone such that the ornament support is supported generally adjacent to the gemstone for accessorizing the gemstone.

The present invention provides substantial improvements over those jewelry accessories found in the prior art. For example, the accessory may be quickly and easily added to practically any gemstone setting to accessorize a particular gemstone. Furthermore, the number and types of ornaments which can be mounted on the ornament support section and arrayed around the gemstone is virtually unlimited and could conceivably include such items as professional or college team logos, hearts, moons, clovers, or any other type of ornament desired by the wearer. Also, because the user of the present invention could own several different types of interchangeable jewelry accessories, the same pendant or ring may be worn with a variety of outfits when combined with the appropriate jewelry accessory design. It is thus seen that the present invention provide a substantial improvement over those jewelry accessory items found in the prior art.

BRIEF DESCRIPTION OF THE DRAWINGS

Finally.

DESCRIPTION OF THE PREFERRED EMBODIMENT

Figure 2:
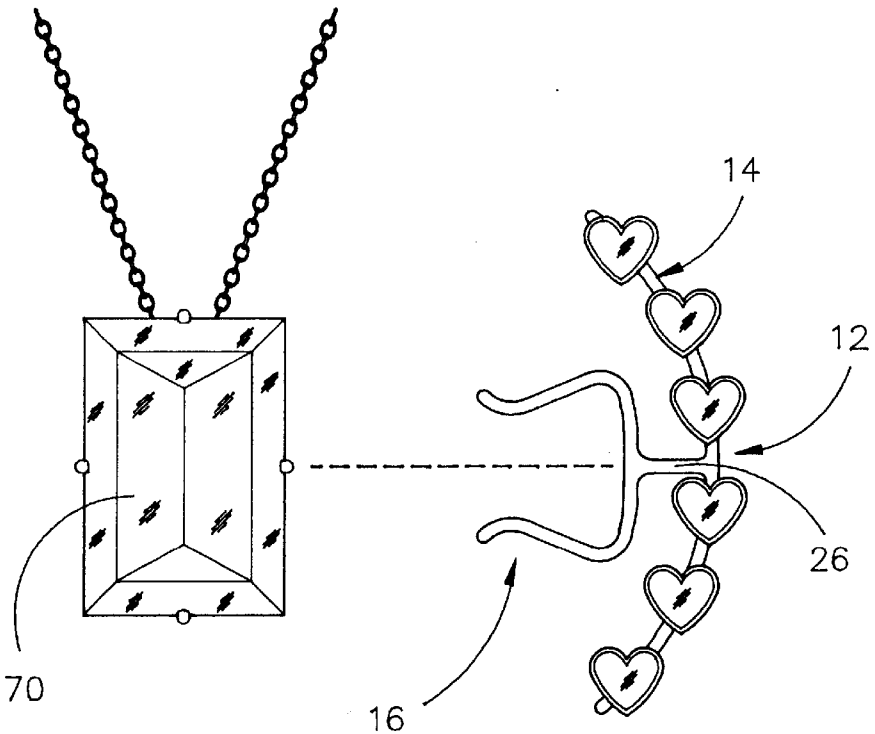
FIG. 2 is a front elevational view of the accessory of FIG. 1 showing the accessory being removed from the gemstone setting.
Figure 1:
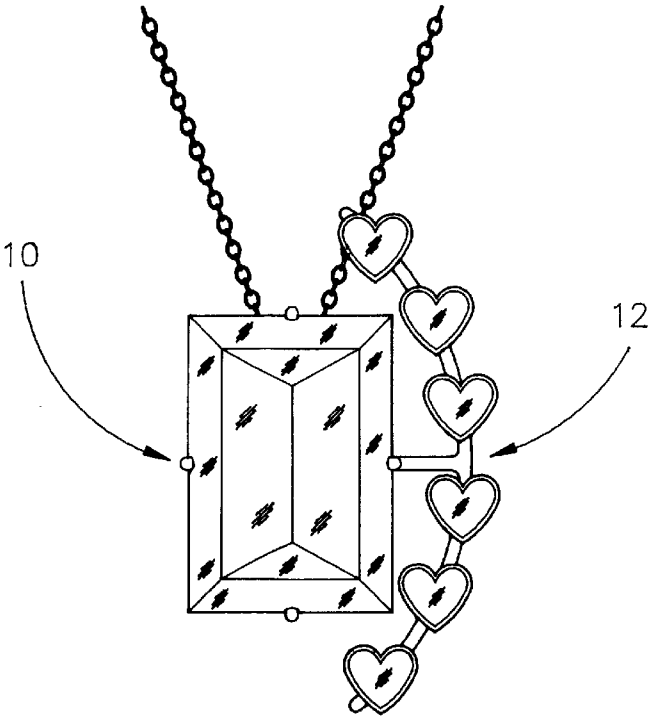
FIG. 1 is a front elevational view of the present invention mounted on a pendant as an accessory.
Figure 3:
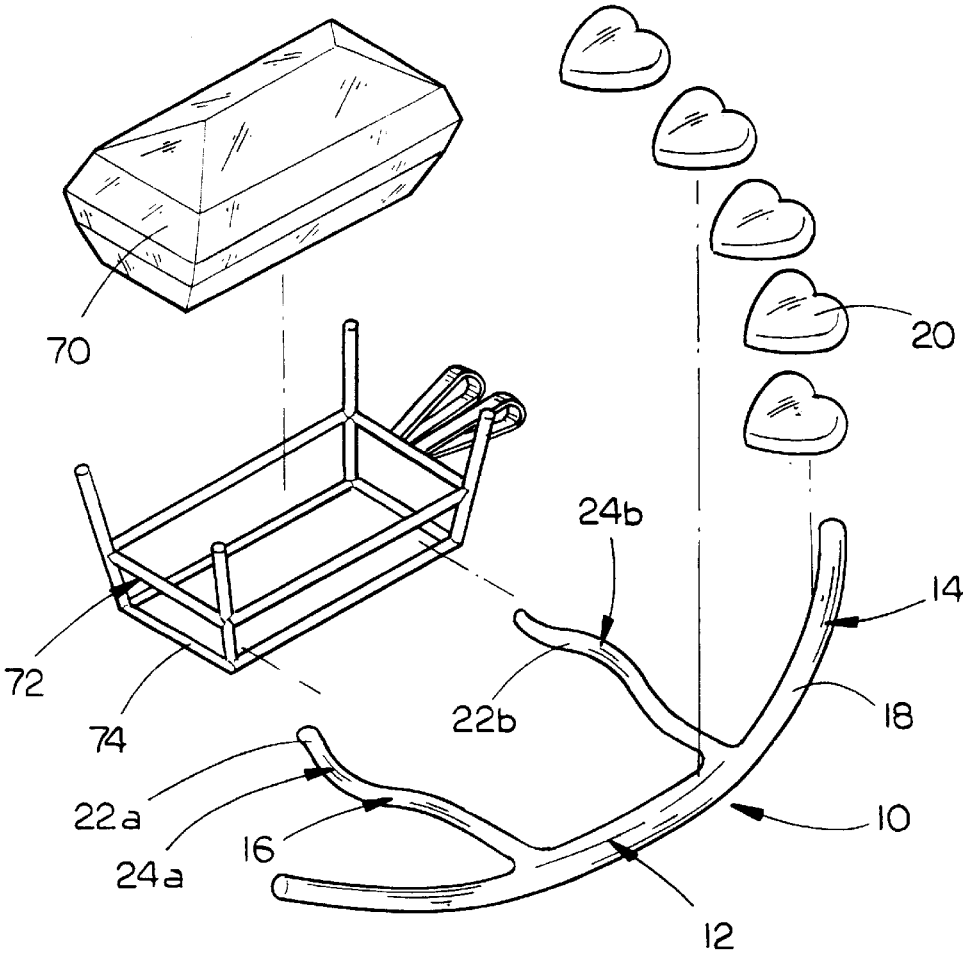
FIG. 3 is a exploded perspective view showing the gemstone removed from the setting so that the way in which the clip section fits into the setting can be better seen.
Figure 4:
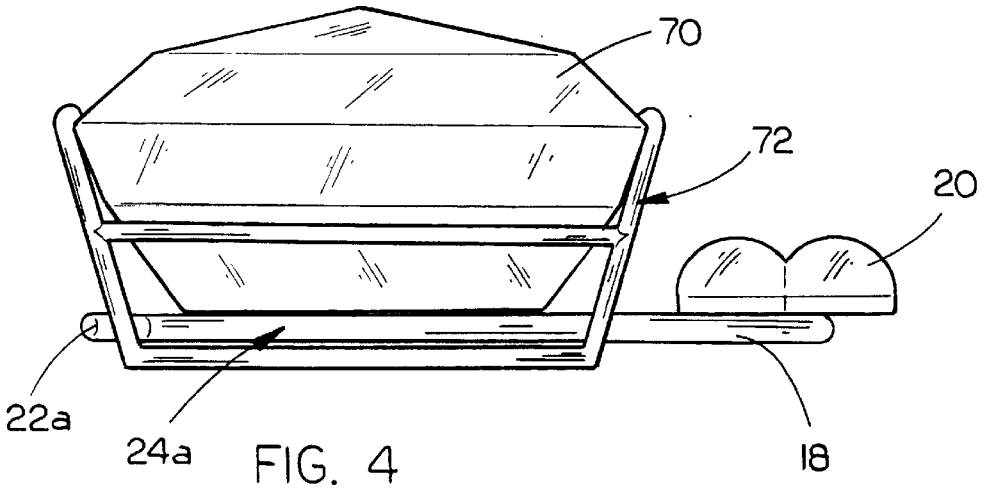
FIG. 4 is a side elevational view of a gemstone having the interchangeable jewelry accessory of the present invention mounted adjacent thereto.

The interchangeable jewelry accessory 10 of the present invention is best shown in FIGS. 1–6 as including an ornament support base 12 which includes an arcuate ornament support section 14 and a setting-engaging clip section 16 which projects outwards from the ornament support section 14 as shown best in FIGS. 2 and 3.

In the preferred embodiment, the ornament support section 14 will be constructed as an arcuate elongated rod 18 which supports the ornaments 20 mounted thereon in a generally semi-circular manner around the gemstone 70. It is further preferred that the rod 18 be constructed of a malleable metal which could be steel, aluminum or a precious metal such silver, gold or platinum. The precise dimensions of rod 18 are not critical to the present invention, however, it is preferred that the rod 18 be very thin (less than one-eighth of an inch in diameter) in order to remain as unobtrusive as possible and not draw attention away from the ornaments 20 or gemstone 70.

Figure 5:
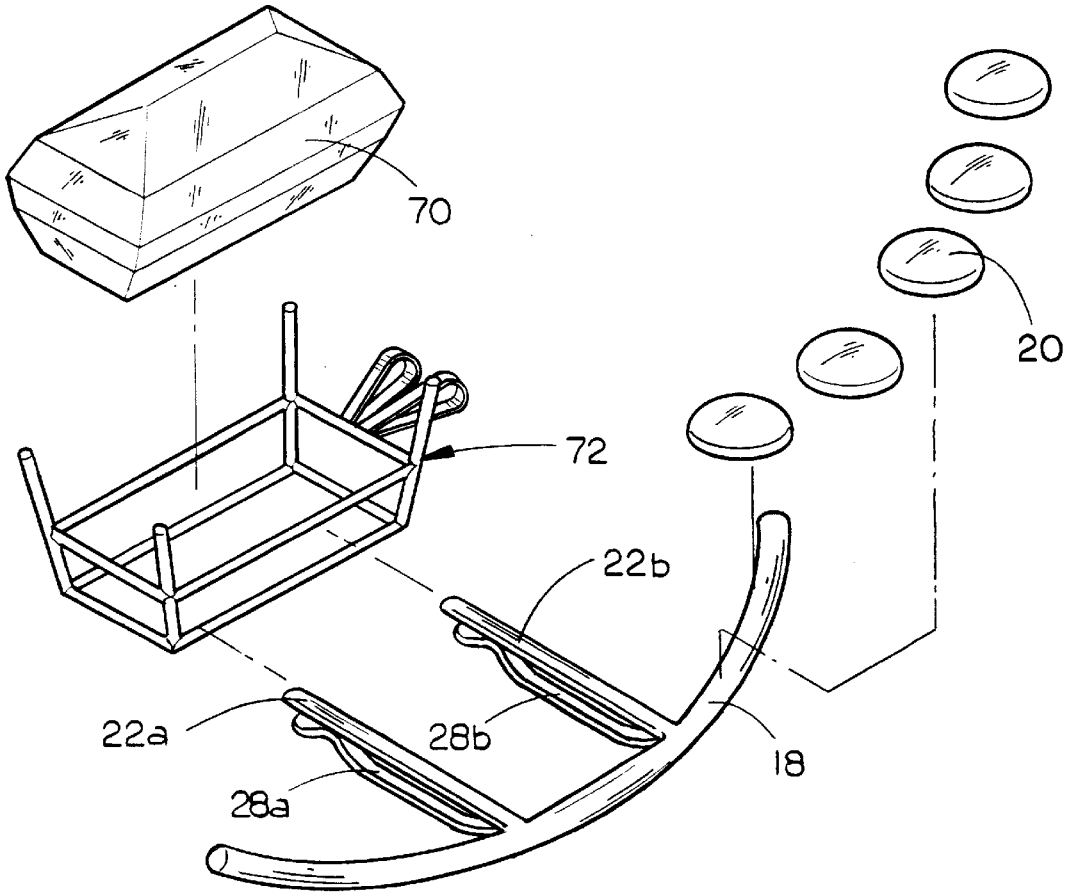
FIGS. 5 and 6 show an alternative embodiment of the interchangeable jewelry accessory of the present invention with a different type of clip section being used for attachment to the setting-mounted gemstone.

Three variations of the clip section 16 are shown in FIGS. 2, 3, and 5, respectively, each of which can be used with a particular type of gemstone setting. The clips shown in FIGS. 2 and 3 operate in much the same fashion, and therefore the following description, although applied generally to FIGS. 3 and 4, should also be understood to apply to the embodiment of FIGS. 1 and 2 in general operation thereof.

The setting-engaging clip section 16 of FIG. 3 is shown as including two projecting arms 22*a* and 22*b* which are preferably constructed of materials similar to that used in connection rod 18. Due to the narrow diameter of projecting arms 22*a* and 22*b* the arms 22*a* and 22*b* are slightly flexible and resilient and may be flexed towards one another when force is applied to the projecting arms 22*a* and 22*b* as will be done by a finger and thumb of a wearer of the interchangeable jewelry accessory 10. The distance between projecting arms 22*a* and 22*b* is slightly less than the width of the gemstone setting 72 onto which the interchangeable jewelry accessory 10 is to be mounted. Projecting arms 22*a* and 22*b* each will also include a securement section 24*a* and 24*b* which, in the embodiment of FIG. 3, is an outwardly projecting curved section of each projecting arm 22*a* and 22*b*. When the wearer of the interchangeable jewelry accessory 10 desires to place the accessory onto the gemstone setting 72, projecting arms 22*a* and 22*b* are flexed towards one another and then slid into the gemstone setting 72 above the base 74 of gemstone setting 72 but below the position of the gemstone 70, as shown best in FIG. 4. When the tension on projecting arms 22*a* and 22*b* is removed, the arms 22*a* and 22*b* return to their original positions and the securement sections 24*a* and 24*b* of projecting arms 22*a* and 22*b* extend slightly beyond the top and bottom of the gemstone setting 72, thus securing the interchangeable jewelry accessory 10 on the gemstone setting 72, as shown best in FIG. 4. The clip section 16 shown in FIG. 2 would operate in much the same manner, but is connected to ornament support section 14 by only a single connection strut 26.

Figure 6:
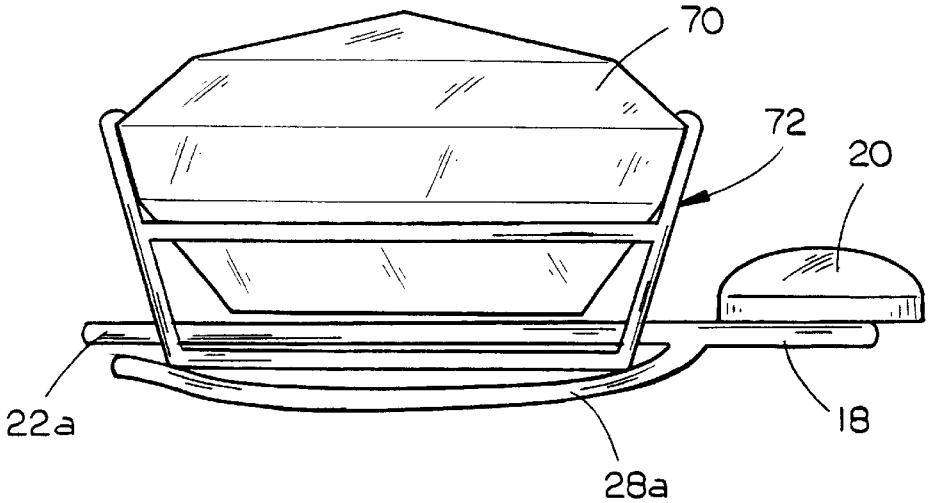

The embodiment shown in FIGS. 5 and 6 discloses a variation of the setting-engaging clip section 16 which again includes the projecting arms 22*a* and 22*b* but also includes securement clips 28*a* and 28*b* which are mounted beneath each projecting arm 22*a* and 22*b*. As the projecting arms 22*a* and 22*b* are slid into the gemstone setting 72, the arms 22*a* and 22*b* are above base 74 of gemstone setting 72 while the securement arms 28*a* and 28*b* are beneath base 74 and deform downwards slightly when being inserted onto base 74. When the projecting arms 22*a* and 22*b* are moved as far onto base 74 as permitted by securement arms 28*a* and 28*b*, the upwardly curved end of each securement arm 28*a* and 28*b* firmly engages the base 74 of gemstone setting 72, thus securing the ornament support base 12 on the gemstone setting 72 so that ornaments 20 are supported adjacent gemstone 70. Of course, it is to be understood that numerous modifications and variations of the projecting arms 22*a* and 22*b* and securement sections 24*a*, 24*b*, 28*b* and 28*b* may be used with the present invention so long as the primary function of releasably securing the interchangeable jewelry accessory 10 to the gemstone setting 72 is achieved.

Figure 7:
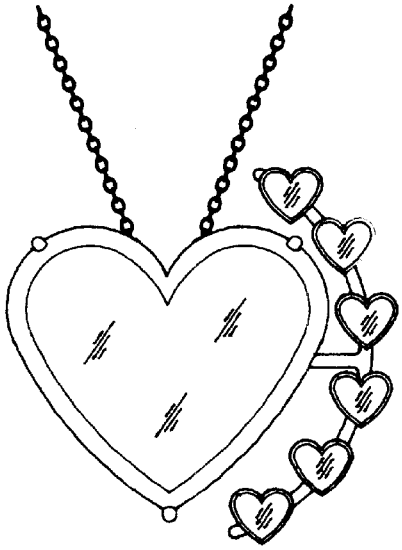
FIGS. 7–10 show suggested alternative ornamental designs which may be used with the interchangeable jewelry accessory of the present invention.
Figure 8:
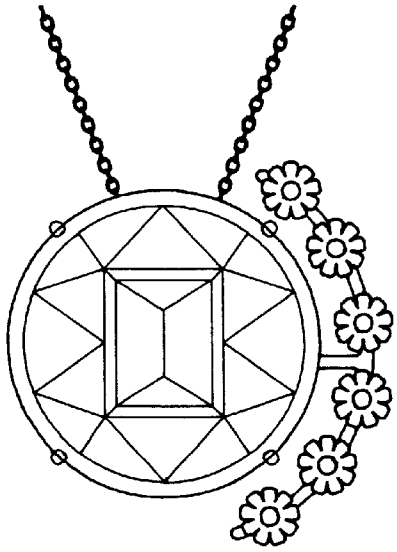
Figure 9:
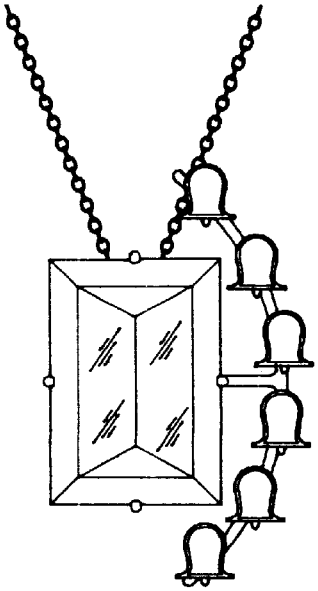
Figure 10:
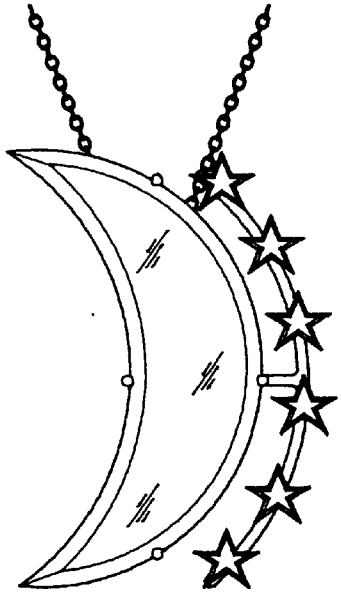

One of the exciting and unique features of the present invention is that the types of ornaments 20 mounted on ornament support section 14 may be of an almost limitless variety. For example, FIG. 7 shows a typical heart-shaped pendant being accessorized by a plurality of heart-shaped ornaments supported by the ornament support base 12 adjacent the heart-shaped pendant for individualizing the piece of jewelry. Likewise, the variation shown in FIGS. 8, 9 and 10, each serve to individualize and render unique a particular piece of jewelry. In this manner, although thousands of persons many own copies of one particular jewelry piece, each owner of the jewelry piece may accessorize the jewelry by the addition of his or her own particular ornamental style. Furthermore, because the present invention may be quickly and easily mounted on the gemstone setting 72, several different ornament styles may be used for the same piece of jewelry whereby the jewelry piece may be worn with various outfits and in various situations. Also, it is contemplated that various team logos or college insignias may be mounted on the ornament support base 12 and used for jewelry to accent the jewelry and "make a statement."

It is to be understood that numerous modifications, additions and substitutions may be made to the interchangeable jewelry accessory 10 of the present invention which fall within the intended broad scope of the appended claims. For example, the setting-engaging clip section 16 may be of many different styles depending on the gemstone setting to which the accessory is being connected, such as button-type clips, lock-type clasps which could extend between the projecting arms or slide-type locking mechanisms. Furthermore, while the interchangeable jewelry accessory 10 of the present invention as shown is generally including an arcuate arrangement of ornaments 20 around the central gemstone 70 it is to be understood that any type of geometric arrangement, including a single ornament, could be used in connection with the present invention. Furthermore, the use of two or more accessories 10 mounted on the same gemstone setting 72 is contemplated, should the user of the interchangeable jewelry accessory 10 of the present invention choose to do so. Finally, it is to be understood that the present invention is easily modified for accessorizing any type of gemstone, one or multiple gemstones, any type of setting used for mounting those gemstones, and any size of gemstone, from multiple small carat stones to single large ones.

There has therefore been shown and described an interchangeable jewelry accessory which accomplishes at least all of the stated objectives.

I claim:

1. In combination:

a gemstone setting having at least one gemstone set therein, said gemstone setting including a base, an upwardly projecting framework mounted on said base and a gemstone securement means directly mounted on said framework; and an interchangeable jewelry accessory for accessorizing said gemstone setting including;

an ornament support base having an ornament support section and a setting-engaging clip section securely mounted on and projecting from said ornament support section;

said ornament support section including an ornament mount and at least one ornament mounted on said ornament mount;

said setting-engaging clip section including at least one projecting arm having releasable securement means thereon, said releasable securement means operative to releasably engage said framework of said gemstone setting such that said at least one projecting arm is releasably secured on said gemstone setting such that said ornament support section is supported generally adjacent to said gemstone and said at least one ornament is spaced from said gemstone setting for accessorizing said gemstone.

2. The combination of claim 1 wherein said ornament support section comprises an elongated rod such that upon said ornament support section being supported generally adjacent said gemstone, said rod at least partially surrounds said gemstone.

3. The combination of claim 1 wherein said setting-engaging clip section comprises at least two generally parallel projecting arms extending from said ornament support section.

4. The combination of claim 3 wherein said releasable securement means comprises an outwardly projecting curved section of each of said projecting arms, said curved section operative to retain said accessory on said setting by said projecting arms being flexed towards one another and then slid into said gemstone setting, said projecting arms then being released whereby said arms return to their original positions and said curved sections of said projecting arms extend slightly beyond the edges of said gemstone setting, thereby securing said interchangeable jewelry accessory on said gemstone setting.

5. The combination of claim 3 wherein said releasable securement means comprises at least two securement clips having upwardly curved ends each mounted beneath one of said projecting arms, said at least two securement clips operating such that as said projecting arms are slid into the gemstone setting above said base, said at least two securement clips are slid underneath said base of said gemstone setting and said upwardly curved end of each of said at least two securement clips firmly engages a portion of said framework of said gemstone setting, thereby releasably securing said interchangeable jewelry accessory on said gemstone setting.

* * * * *